US005508792A

United States Patent [19]

Ishida et al.

[11] Patent Number: 5,508,792

[45] Date of Patent: Apr. 16, 1996

[54] DEVELOPING UNIT INCLUDING A PARTITION WALL DEFINING A NON-AGITATION SPACE IN A DEVELOPER CONTAINER

[75] Inventors: Naoyuki Ishida; Tadakazu Ogiri; Koichi Yasuda; Hisayuki Tachibana, all of Osaka, Japan

[73] Assignee: Mita Industrial Co, Ltd., Japan

[21] Appl. No.: 398,785

[22] Filed: Mar. 6, 1995

[30] Foreign Application Priority Data

Mar. 15, 1994 [JP] Japan ..... 6-044223

[51] Int. Cl.[6] ..... G03G 15/08

[52] U.S. Cl. ..... 355/245; 222/DIG. 1

[58] Field of Search ..... 355/260, 245, 355/210, 200; 222/DIG. 1, 413

[56] References Cited

U.S. PATENT DOCUMENTS 4,478,512 10/1984 Zoltner ..... 222/DIG. 1
4,583,842 4/1986 Shimono et al. ..... 355/260
5,153,646 10/1992 Abuyama et al. ..... 355/245
5,172,168 12/1992 Satoh et al. ..... 355/245
5,398,106 3/1995 Eguchi ..... 355/260

FOREIGN PATENT DOCUMENTS 1142762 6/1989 Japan ..... 355/260

*Primary Examiner*—Joan H. Pendegrass
*Assistant Examiner*—Sophia S. Chen
*Attorney, Agent, or Firm*—Beveridge, DeGrandi, Weilacher & Young

[57] ABSTRACT

A developing unit comprises a developer container having an agitation space for agitating developer therein and a toner hopper for feeding toner to the agitation space of the developer container. A lower wall of the toner hopper includes a toner drop port allowing toner to fall into the aforesaid agitation space. On a surface of the lower wall exposed to the agitation space, disposed is a partition wall surrounding the periphery of the toner drop port. The partition wall defines a non-agitation space. The toner is allowed to fall from the toner drop port smoothly into the agitation space through the non-agitation space which is not affected by the agitation.

20 Claims, 5 Drawing Sheets

DEVELOPING UNIT INCLUDING A PARTITION WALL DEFINING A NON-AGITATION SPACE IN A DEVELOPER CONTAINER

CROSS REFERENCE TO RELATED APPLICATION

This application claims priority benefits under 35 U.S.C. §119 of Japanese Patent Application No. 6-44223, the disclosure of which is incorporated herein by reference.

BACKGROUND OF THE INVENTION

1. Field of the Invention

The present invention relates to a developing unit comprising a developer container and a toner hopper for supplying the same with toner.

2. Description of Related Art

Recently, a unit is provided with a screw conveyer having a blade which is adapted to agitate a developer material in a developer container. This unit is provided as a system for agitating the developer in the developer container of an image forming apparatus. Additionally, the developer container of this type employs a so-called one-point drop system for feeding toner to the developer container. This system is arranged such that the screw conveyer is used to convey toner in a toner hopper while agitating it, and the toner thus conveyed is fed to the developer container thereunder through a toner drop port provided at the toner hopper. The toner drop port generally comprises small holes which are defined in a predetermined position of a lower wall, as running downward or sideward.

The toner hopper of the aforedescribed one-point drop system suffers from the following two problems (i) and (ii).

(i) When the main body of an image forming apparatus is inclined during installation or when a clam-shell type image forming apparatus is opened for jam recovery, a developing unit including the toner hopper may in some cases be inclined. In such a case, developer in the developer container flows back to the toner hopper side through the aforesaid toner drop port, which leads to a failure to maintain a constant supply of the toner.

(ii) Under the aforesaid toner drop port, there exists a strong flow of developer caused by a spiral shaft, adversely affecting a smooth downflow of toner from the toner hopper. This also results in a failure to maintain a constant supply of the toner.

SUMMARY OF THE INVENTION

In view of the foregoing, it is the main object of the present invention to provide a developing unit capable of assuring a constant supply of toner.

To attain the aforementioned object, a developing unit according to an embodiment of the present invention comprises a developer container within which an agitation space for agitating developer therein is defined, and a toner hopper disposed above the aforesaid agitation space in the aforesaid developer container, the aforesaid toner hopper comprising:

a hopper housing containing toner therein, the inner part of which is separated from the agitation space by a lower wall, a toner drop port defined in the aforesaid lower wall allowing the toner in the aforesaid hopper housing to fall into the aforesaid agitation space, and a partition wall formed on a surface of the aforesaid lower wall exposed to the agitation space and surrounding at least a part of the periphery of the aforesaid toner drop port, thus defining a non-agitation space within the aforesaid agitation space.

According to this embodiment, the partition wall formed on the surface of the lower wall exposed to the agitation space surrounds at least a part of the periphery of the toner drop port so that the non-agitation space can be defined within the aforesaid agitation space. Toner is allowed to fall from the toner drop port smoothly in the agitation space through the aforesaid non-agitation space which is not affected by agitation of toner, and hence a constant supply of the toner is assured.

DETAILED DESCRIPTION OF THE PREFERRED EMBODIMENTS

The developing unit according to the present invention will be described in detail with reference to the drawings illustrating an embodiment thereof.

Figure 2:
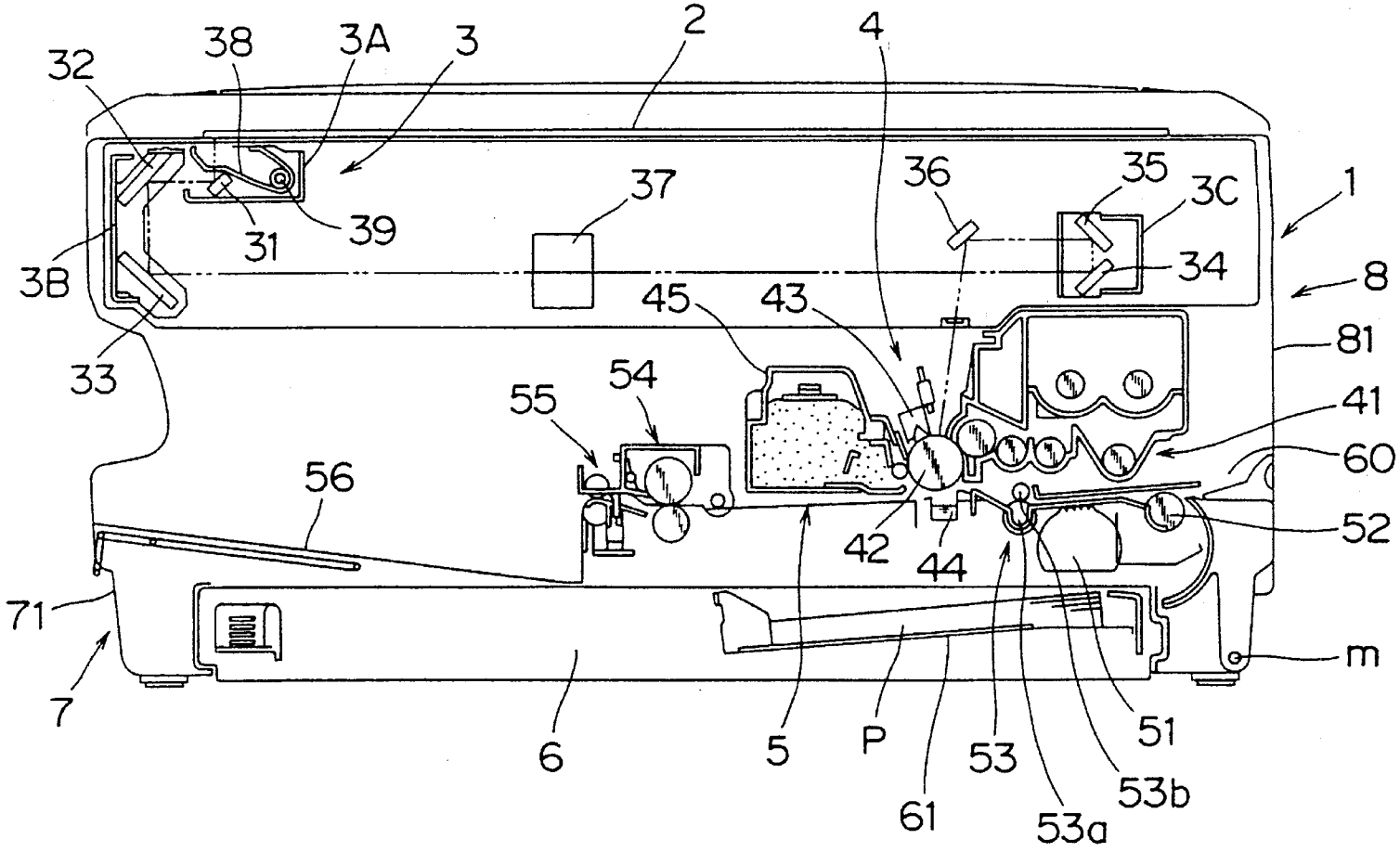
FIG. 2 is a conceptual diagram illustrating an internal construction of a copying machine including the developing unit.

A developing unit according to an embodiment of this invention is applied to, for example, a copying machine operating as an image forming apparatus as shown in FIG. 2. Now referring to FIG. 2, the main body of a copying machine 1 includes therein (1) an optical system 3 for illuminating and scanning a document original placed on a transparent platen 2 and focusing image rays reflected from the illuminated document original onto a photoconductive drum 42, (2) an image processing portion 4 wherein a latent electrostatic image produced on the photoconductive drum 42 is developed into a toner image by a developing unit 41, and thereafter the image thus developed is transferred to a sheet of copy paper, and (3) a paper transport portion 5 which utilizes a paper take-up roll 51 having a semi-circular form in section to draw out the aforesaid paper from a paper feed tray 61 in a paper containing portion 6 and conveys the paper to a copy tray 56 in the main body of the copying machine via the image processing portion 4.

The main body of the copying machine 1 comprises a lower unit 7 defined by a lower casing 71, and an upper unit 8 defined by an upper casing 81 as relatively turnably supported with respect to the lower unit 7 around a predetermined pivotal axis m disposed at an end thereof. The main body of the copying machine 1, has a so-called clam-shell type structure wherein the upper unit 8 is relatively turnable with respect to the lower unit 7, to thereby allow the inner part thereof to be exposed.

The optical system 3 illuminates a document original by means of a fluorescent lamp 39 having a reflector 38 which is secured to a first shift frame 3A, and focuses image rays reflected from the document original onto the photoconductive drum 42 sequentially through a first mirror 31 secured to the first shift frame 3A, a second mirror 32, a third mirror 33 and a lens 37 secured to a second shift frame 3B, a fourth mirror 34, a fifth mirror 35 and a sixth mirror 36 secured to a third shift frame 3C.

The image processing portion 4 has a drum charge corona 43, the developing unit 41, an image transfer corona 44 and a cleaning unit 45 disposed around the photoconductive drum 42 in the order named. The image processing portion 4 is adapted such that a latent electrostatic image is produced by focusing image rays reflected from the document original on the outer peripheral surface of the uniformly charged photoconductive drum 42; thereafter the latent electrostatic image thus produced is developed into a toner image by the developing unit 41; the toner image so developed is transferred to a sheet of copy paper by the image transfer corona 44; and the residual toner is recovered by the cleaning unit 45.

The paper transport portion 5 comprises the aforesaid paper take-up roll 51 for sequentially drawing out copy paper P from the paper feed tray 61, a transport roller 52 for advancing the copy paper from a manual feed portion 60 or the paper feed tray 61, a main roller 53*a* and a driven roller 53*b* constituting resist means 53 against which the leading edge of the paper sent by the transport roller 52 is made to abut to thereby keep the paper temporarily in the stand-by condition, a fixing portion 54 for fixing the toner image transferred to the paper, and a pair of paper exit rollers 55.

Figure 1:
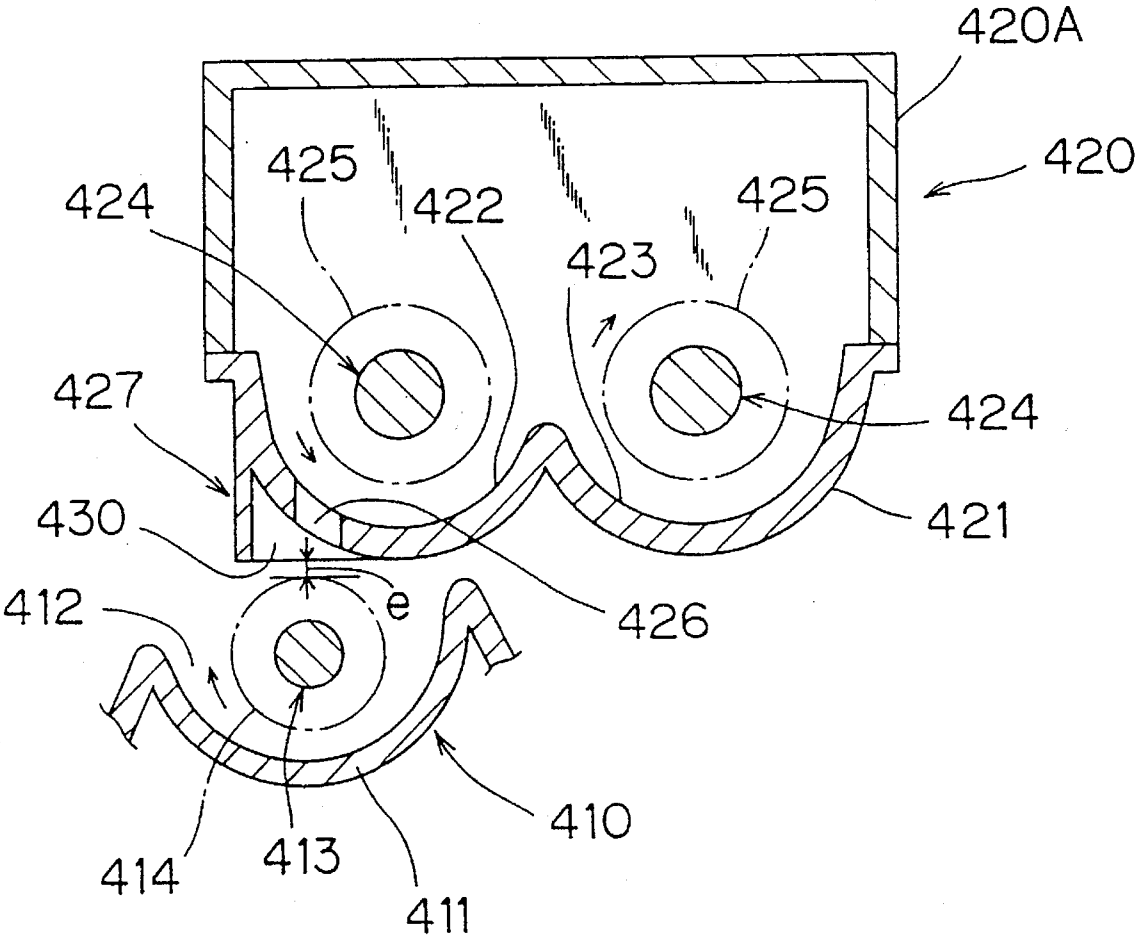
FIG. 1 is a sectional view illustrating a principal part of a developing unit according to an embodiment of the present invention.

With reference to FIG. 1, the aforesaid developing unit 41 has a developer container 410 in which a developer is agitated, and a toner hopper 420 for feeding toner to an agitation space in the developer container 410. The developer container 410 has an agitation space 412 defined therein by the housing 411 thereof, and developer in the agitation space 412 is stirred by a screw conveyer 413 for developer agitation which includes a blade 414 wound thereon in a spiral form.

A hopper housing 420A of the toner hopper 420 has a lower wall 421 substantially formed like W in section which partitions the agitation space thereunder. On the upper surface of this lower wall 421, two rows of gutter parts 422, 423 are defined. The gutter part 422 is closer to the photoconductive drum 42 than the gutter part 423. Each of the gutter parts 422, 423 includes therein a screw conveyer 424 for agitating and transporting toner which has a blade 425 wound thereon in a spiral form. In the lower part of the gutter part 422, a toner drop port 426 is defined which; opens obliquely downward, to allow toner in the toner hopper 420 to fall into the developer container 410. The gutter part 422 has a partition wall 427 which surrounds a part of the periphery of the toner drop port 426 and extends downward.

Figure 3:
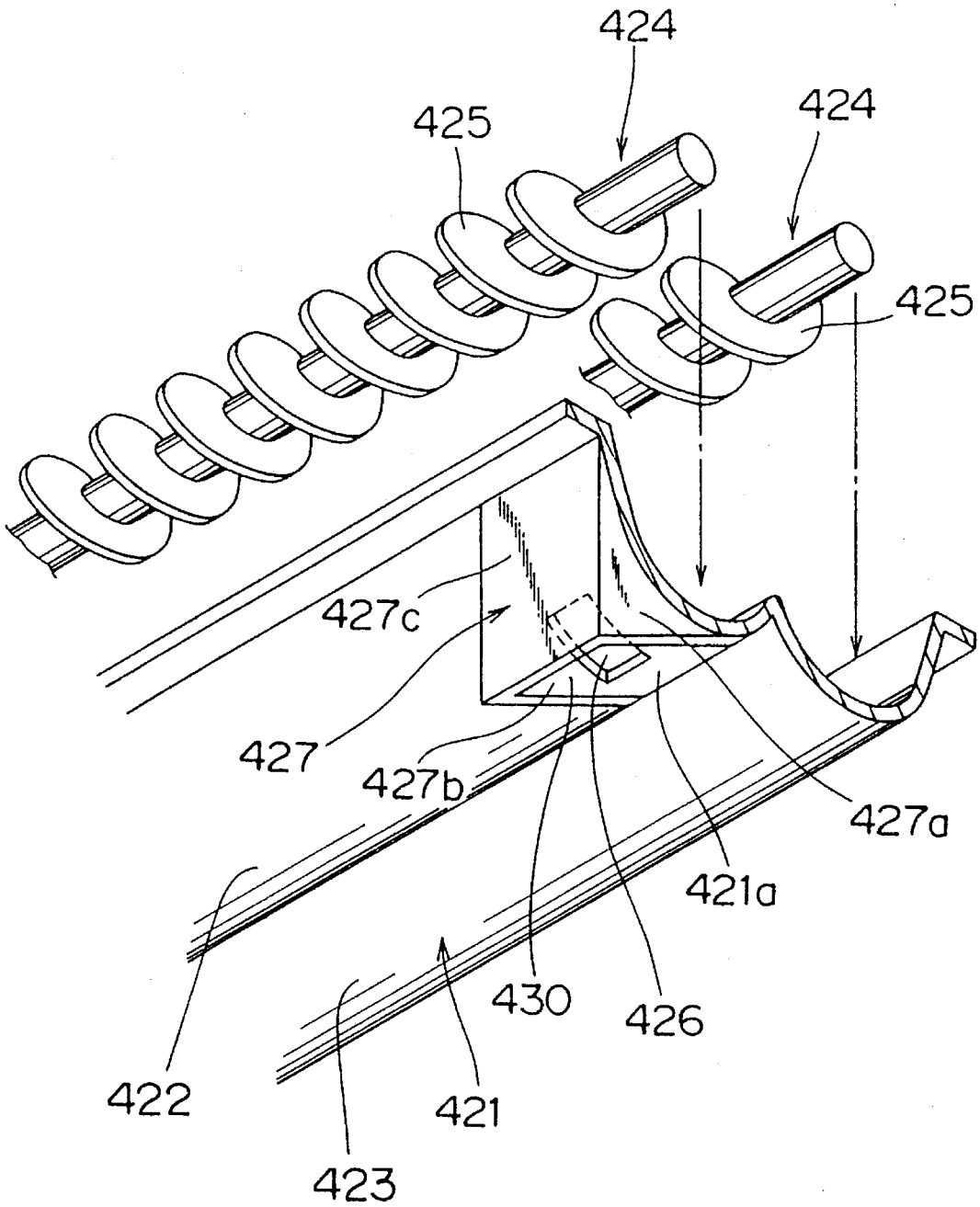
FIG. 3 is an exploded view in perspective of a principal part of a toner hopper as seen from below.
Figure 4:
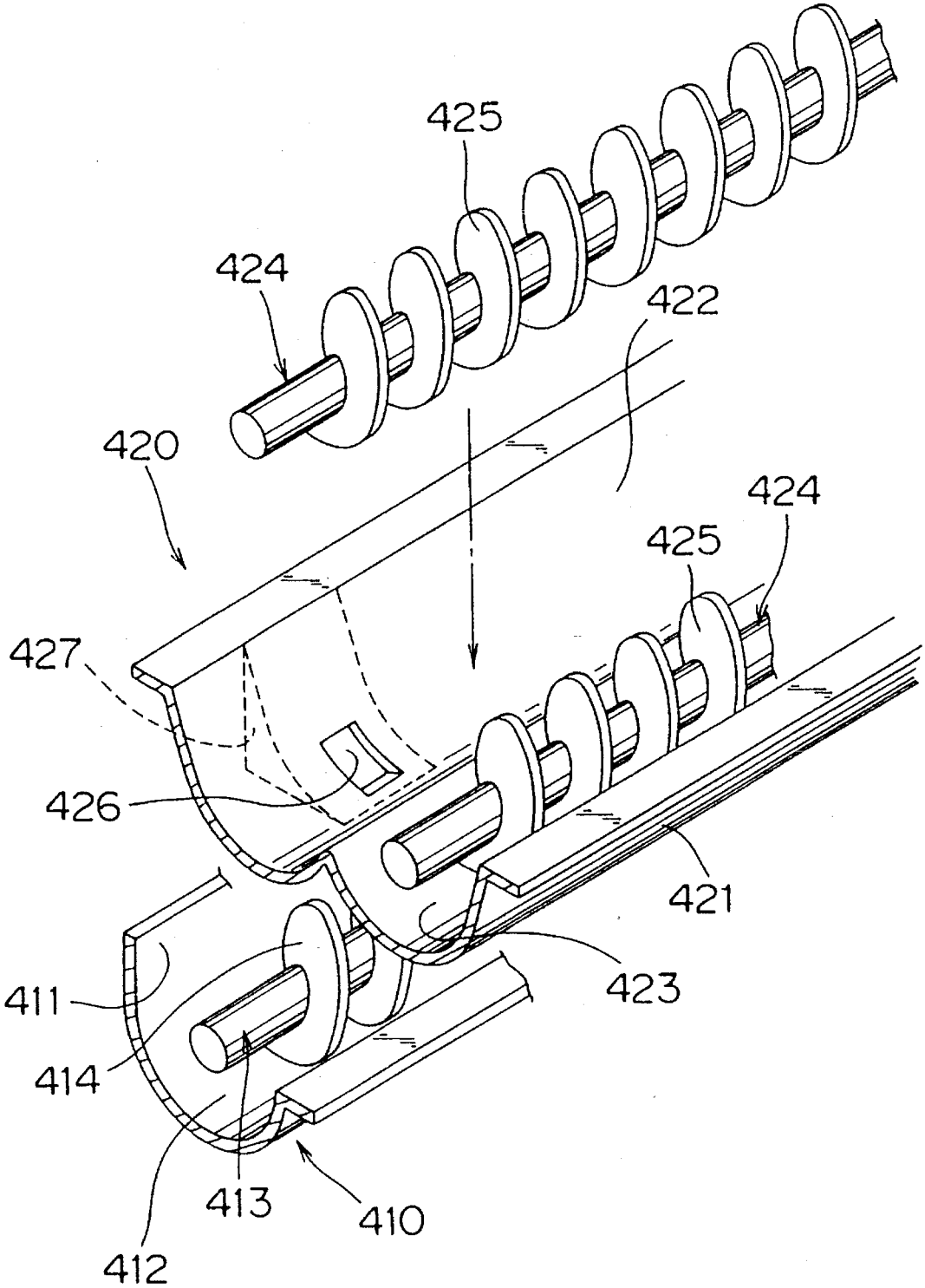
FIG. 4 is an exploded view in perspective of a principal part of a toner hopper and a developing unit as seen from above.

Referring to FIGS. 3 and 4, the aforesaid partition wall 427 is defined on the lower surface of the aforesaid lower wall 421, surrounding the periphery of the aforesaid toner drop port 426 in cooperation with the lowermost part 421a of the aforesaid lower wall 421. A space surrounded by this partition wall 427 constitutes a non-agitation space 430. The partition wall 427 comprises a pair of parts 427*a*, 427*b* orthogonal to the direction of the shaft of the aforesaid screw conveyer 424, and a part 427*c* parallel to the direction of the shaft of the aforesaid screw conveyer 424. The developing unit 41 is mounted in the upper unit 8 of the main body of the copying machine 1 while the aforementioned screw conveyer 424 is disposed in parallel to the pivotal axis m of the upper unit 8 of the main body of the copying machine 1, and hence the aforesaid parallel part 427*c* of the aforesaid partition wall 427 runs at a right angle to an inclination direction of the upper unit 8 when the main body of the copying machine 1 is opened.

As shown in FIG. 3, the parts 427*a*, 427*b*, 427*c* of the aforesaid partition wall 427 are spaced a certain distance from the circumference of the toner drop port 426 respectively.

With reference to FIG. 1, the edge of the aforesaid blade 414 and the lower end of the aforesaid partition wall 427 are spaced from each other by a predetermined distance of e. This prevents the developer conveyed by the screw conveyer 413 from unwantedly hitting against the partition wall 427, thereby ensuring that the agitation of the developer is not disturbed by the partition wall 427.

According to this embodiment of the invention, the partition wall 427 formed on the lower surface of the lower wall 421 of the toner hopper 420 surrounds the periphery of the toner drop port 426, thus defining the aforesaid non-agitation space 430 within the aforesaid agitation space 412. Further, toner is allowed to fall from the toner drop port 426 smoothly in the agitation space 412 through the aforesaid non-agitation space 430 which is not affected by toner agitation, and hence a constant supply of the toner is assured.

Additionally, each of the parts 427*a* through 427*c* of the aforesaid partition wall 427 is a given distance away from the circumference of the toner drop port 426, so that the fall of toner from the toner drop port 426 is further facilitated.

Even if the developing unit 41 is inclined to perform a jam recovery, the aforesaid parallel part 427c of the aforesaid partition wall 427 is orthogonal to an inclination direction of the developing unit 41, which prevents the developer from flowing back from the agitation space 412 through the toner drop port into the toner hopper 420. As a result, a constant supply of the toner is assured.

Figure 5:
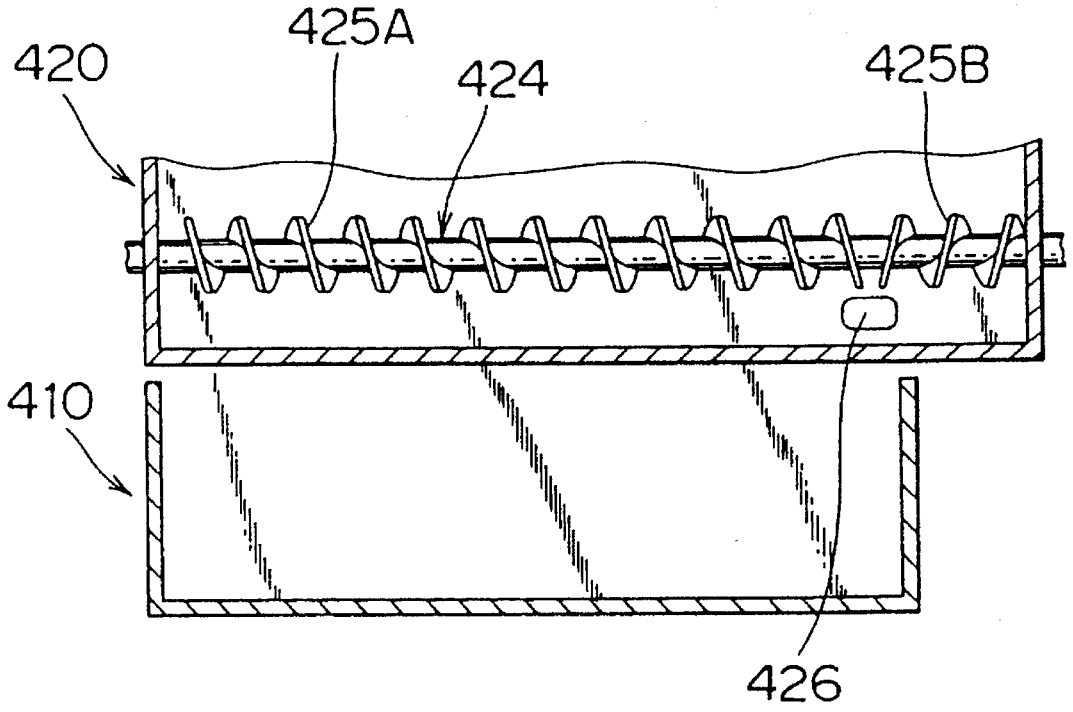
FIG. 5 is a schematic sectional view illustrating a developing unit according to another embodiment of the present invention.

FIG. 5 illustrates another embodiment of the present invention. With reference to the same figure, this embodiment differs from the above described embodiment in the following two points (i) and (ii).

(i) The screw conveyer 424 spans over the toner drop port 426 and has blades 425A, 425B starting from the aforesaid toner drop port 426 in different winding directions to each other.

(ii) In association with the above arrangement (i), an end portion of the toner hopper 420 is protruded longitudinally from an end of the developer container 410. The arrangement of the other parts is the same with the aforesaid embodiment, and therefore the same reference characters and the description thereof is omitted.

This embodiment has the following effects. It is possible for the toner hopper 420 to have a larger space than the developer container 410 because of the expansion; in the longitudinal direction thereof, so that an amount of toner to be stored therein can be increased. Furthermore, the toner hopper 420 uses the aforesaid counterwound blade 425B to smoothly convey the toner contained in the part thereof protruding from the developer container 410, thereby avoiding the situation that this part makes a dead space. Even if interference with other parts makes it difficult to provide a sufficient space for the toner hopper 420, the toner hopper 420 can secure a sufficient space as long as it can extend itself in the longitudinal direction thereof. Accordingly this can enhance freedom of design.

It is to be expressly understood that the present invention should not be limited to the above embodiments and includes various modifications thereof without departing from the scope and spirit of the invention.

What is claimed is:

1. A developing unit including a developer container within which an agitation space for agitating a developer therein is defined, and a toner hopper disposed above said agitation space of said developer container, wherein said toner hopper comprises:

a hopper housing containing toner therein, wherein an inner part of the hopper housing is separated from said agitation space by a lower wall, a toner drop port defined in said lower wall for allowing toner in said hopper housing to fall into said agitation space, and a partition wall formed on a surface of said lower wall exposed to said agitation space, the partition wall surrounding at least a part of a periphery of said toner drop port to thereby define a non-agitation space within said agitation space.

2. A developing unit as set forth in claim 1, wherein said partition wall is spaced a predetermined distance from said periphery of said toner drop port.

3. A developing unit as set forth in claim 1, wherein:

said developer container further includes a screw conveyer having a spiral-formed blade for agitating toner in said agitation space, and an edge of said blade and a lower end of said partition wall are spaced from each other by a predetermined distance.

4. A developing unit as set forth in claim 1, wherein:

said developer container further includes a screw conveyer having a spiral-formed blade for agitating developer in said agitation space, and said-partition wall includes a pair of parts orthogonal to a shaft of said screw conveyer, and a part parallel to said shaft of said screw conveyer.

5. A developing unit according to claim 1, wherein the lower wall of the toner hopper defines two gutter parts in the toner hopper.

6. A developing unit according to claim 5, wherein each gutter part has a screw conveyor having a spiral-formed blade.

7. A developing unit according to claim 1, wherein the toner hopper has a longitudinal length which is greater than a longitudinal length of the developer container.

8. A developing unit according to claim 7, wherein the toner hopper has a screw conveyor having a spiral-formed blade.

9. A developing unit according to claim 8, wherein the spiral-formed blade has two different winding directions.

10. A developing unit mounted in an upper unit of an image forming apparatus including a lower unit and the upper unit which are rotatably connected to each other around a pivotal axis, said developing unit including a developer container within which an agitation space for agitating a developer therein is defined, and a toner hopper disposed above said agitation space of said developer container, wherein:

said developer container further includes a screw conveyer having a spiral-formed blade for agitating developer in said agitation space, and said toner hopper includes a hopper housing for containing toner therein, wherein an inner part of the toner hopper is separated from the agitation space by a lower wall; a toner drop port defined in said lower wall for allowing toner in said hopper housing to fall into said agitation space; and a partition wall which is formed on a surface of said lower wall exposed to the agitation space and surrounding at least a part of a periphery of said toner drop port, thereby defining a non-agitation space within said agitation space, and said partition wall includes a pair of parts orthogonal to a shaft of said screw conveyer and a part parallel to the shaft of said screw conveyer, said parallel part being parallel to said pivotal axis.

11. A developing unit, comprising:

a developer container which defines an agitation space for agitating developer therein, and a toner hopper provided proximate the developer container for supplying toner to the agitation space of the developer container, wherein the toner hopper includes:

a hopper housing for containing toner, wherein an inner part of the hopper housing is separated from the agitation space by a first wall, P1 a toner port defined in the first wall, wherein the toner port is provided for allowing toner in the hopper housing to enter into the agitation space of the developer container, and a partition wall extending from a surface of the first wall exposed to the agitation space, wherein the partition wall extends toward the agitation space, the partition wall surrounding at least a part of a periphery of the toner port to thereby define a non-agitation space, whereby toner from the toner hopper is supplied to the agitation space of the developer container after passing through the non-agitation space.

12. A developing unit as set forth in claim 11, wherein the partition wall is spaced from the periphery of the toner port.

13. A developing unit as set forth in claim 11, wherein the developer container includes a screw conveyer having a spiral-formed blade for agitating toner in the agitation space, and wherein an edge of the blade and a first end of the partition wall are spaced apart from each other.

14. A developing unit as set forth in claim 11, wherein the developer container further includes a screw conveyer having a spiral-formed blade for agitating developer in the agitation space, and wherein the partition wall includes: a first part which is orthogonal to a shaft of the screw conveyer, a second part which is orthogonal to the shaft of the screw conveyer, and a third part which is parallel to the shaft of the screw conveyer.

15. A developing unit according to claim 11, wherein the first wall of the toner hopper defines two gutter parts in the toner hopper.

16. A developing unit according to claim 15, wherein at least one gutter part has a screw conveyor having a spiral-formed blade.

17. A developing unit according to claim 11, wherein the toner hopper has a longitudinal length which is greater than a longitudinal length of the developer container.

18. A developing unit according to claim 17, wherein the toner hopper has a screw conveyor having a spiral-formed blade.

19. A developing unit according to claim 18, wherein the spiral-formed blade has two different winding directions.

20. A developing unit according to claim 17, wherein the toner port of the toner hopper is located proximate one end of the developer container.

* * * * *